US008496400B2

(12) United States Patent
Aeschlimann et al.

(10) Patent No.: US 8,496,400 B2
(45) Date of Patent: Jul. 30, 2013

(54) SLIPFORM PAVER

(75) Inventors: Werner Aeschlimann, Grobbendonk (BE); Ralf Schug, Bürdenbach (DE); Cyrus Barimani, Königswinter (DE); Guenter Haehn, Königswinter (DE)

(73) Assignee: Wirtgen GmbH (DE)

( * ) Notice: Subject to any disclaimer, the term of this patent is extended or adjusted under 35 U.S.C. 154(b) by 102 days.

(21) Appl. No.: 12/874,380

(22) Filed: Sep. 2, 2010

(65) Prior Publication Data

US 2011/0064519 A1 Mar. 17, 2011

(30) Foreign Application Priority Data

Sep. 4, 2009 (DE) ..... 10 2009 040 079
Oct. 29, 2009 (WO) ..... PCT/EP2009/007730

(51) Int. Cl.
*E01C 19/12* (2006.01)
*E01C 19/22* (2006.01)

(52) U.S. Cl.
USPC ..... 404/105; 404/96

(58) Field of Classification Search
USPC ..... 404/96, 98, 105; 37/468; 414/723
See application file for complete search history.

(56) References Cited

U.S. PATENT DOCUMENTS 1,846,138 A 2/1932 Moore
2,953,977 A 9/1960 Warren
2,954,241 A 9/1960 Warren
3,489,431 A 1/1970 McKeon et al.
3,710,695 A 1/1973 Miller et al.
3,797,958 A * 3/1974 Lofaro ..... 404/98
3,954,359 A 5/1976 Larkin
4,068,959 A 1/1978 Pemberton
4,197,032 A 4/1980 Miller
4,355,945 A 10/1982 Pilch (Continued)

FOREIGN PATENT DOCUMENTS

AU 27386 10/1972
DE 9319362 U1 5/1994

(Continued)

OTHER PUBLICATIONS

Barone, Inc., advertisement, Jul. 1995 (or earlier).

(Continued)

*Primary Examiner* — Thomas B Will
*Assistant Examiner* — Abigail A Risic
(74) *Attorney, Agent, or Firm* — Waddey & Patterson, P.C.; Lucian Wayne Beavers

(57) ABSTRACT

A self propelled slipform paver apparatus includes a chassis, a plurality of ground engaging supports, and a plurality of lifting columns extending between the chassis and the ground engaging supports. A chassis mounting unit is connected to the chassis. A mold for flowable material is also included. A mold mounting unit is connected to the mold. One of the chassis mounting unit and the mold mounting unit includes at least one front claw-like fastening member and at least one rear claw-like fastening member. The claw-like fastening members are open in the same direction either in the direction of operation or opposite to the direction of operation. The other of the chassis mounting unit and the mold mounting unit includes at least one front mating member and at least one rear mating member. The mating members are shaped and arranged to be received in the claw-like fastening members.

39 Claims, 8 Drawing Sheets

U.S. PATENT DOCUMENTS

| | | | | |
|---|---|---|---|---|
| 4,391,549 | A | 7/1983 | Murray | |
| 4,566,823 | A | 1/1986 | May | |
| 4,632,595 | A | 12/1986 | Schaeff | |
| 4,701,069 | A | 10/1987 | Whitney | |
| 4,789,266 | A | 12/1988 | Clarke, Jr. et al. | |
| 4,808,026 | A | 2/1989 | Clarke, Jr. et al. | |
| 4,810,162 | A | 3/1989 | Foster | |
| 4,881,867 | A | 11/1989 | Essex et al. | |
| 4,887,680 | A | 12/1989 | Nozaka et al. | |
| 4,900,185 | A | 2/1990 | Foertsch | |
| 4,984,932 | A | 1/1991 | Leone | |
| 4,994,628 | A | 2/1991 | Goddard et al. | |
| 4,997,333 | A | 3/1991 | Ball et al. | |
| 5,050,684 | A | 9/1991 | Vollmer | |
| 5,082,389 | A * | 1/1992 | Balemi | 403/322.3 |
| 5,173,005 | A | 12/1992 | Henderson et al. | |
| 5,332,353 | A | 7/1994 | Arnold | |
| 5,350,250 | A | 9/1994 | Nagler | |
| 5,354,189 | A | 10/1994 | McKinnon | |
| 5,527,129 | A | 6/1996 | McKinnon | |
| 5,549,440 | A * | 8/1996 | Cholakon et al. | 414/723 |
| 5,662,431 | A | 9/1997 | Colvard | |
| 6,058,633 | A * | 5/2000 | Barden | 37/468 |
| 6,109,825 | A | 8/2000 | Yon | |
| 6,233,852 | B1 * | 5/2001 | Pemberton | 37/468 |
| 6,431,785 | B1 * | 8/2002 | Melander | 403/322.1 |
| 6,481,924 | B1 | 11/2002 | Smolders et al. | |
| 6,540,435 | B1 * | 4/2003 | Lizarraga | 404/98 |
| 6,715,957 | B2 | 4/2004 | Colvard et al. | |
| 6,857,842 | B2 * | 2/2005 | Heiple | 414/723 |
| 6,863,470 | B2 * | 3/2005 | Eggleton et al. | 404/98 |
| 6,922,926 | B2 * | 8/2005 | Miller et al. | 37/468 |
| 8,128,390 | B2 * | 3/2012 | O'Hara | 425/63 |
| 2003/0113165 | A1 | 6/2003 | Eggleton et al. | |
| 2004/0165979 | A1 * | 8/2004 | Fatemi | 414/723 |
| 2007/0199214 | A1 * | 8/2007 | McCormick et al. | 37/468 |

FOREIGN PATENT DOCUMENTS

| | | | |
|---|---|---|---|
| DE | 19644397 | A1 | 4/1997 |
| EP | 1103659 | A2 | 5/2001 |
| EP | 2048284 | A1 | 4/2009 |
| FR | 2701047 | A1 | 8/1994 |
| GB | 2331064 | A | 5/1999 |
| WO | 9305241 | A1 | 3/1993 |

OTHER PUBLICATIONS

Wirtgen GmbH brochure, "Slipform paver SP 250 and SP 500", Apr. 1994, 16 pages.

English translation dated Apr. 12, 2012 of International Preliminary Report on Patentability from corresponding International Application PCT/EP2009/007730, 9 pp. (not prior art).

English translation dated Jun. 16, 2010 of International Search Report from corresponding International Application PCT/EP2009/007730, 3 pp. (not prior art).

* cited by examiner

SLIPFORM PAVER

This application claims priority to German patent application No. 10 2009 040 079.6 filed Sep. 4, 2009, and to PCT/EP2009/007730 filed Oct. 29, 2009.

The invention relates to a slipform paver having running gear which carries a chassis able to be adjusted in the heightwise direction, the chassis having a mounting unit for fastening on an arrangement for moulding flowable material. As well as this, the invention also relates to an arrangement for moulding flowable material for a slipform paver and to a slipform paver for moulding flowable material.

Slipform pavers for the continuous production of items from a flowable material are known. With the known slipform pavers it is for example possible to produce road surfacings, crash barriers and road gutters from concrete. The known slipform pavers have an arrangement in which the flowable material is formed to the desired shape. An arrangement of this kind for moulding the flowable material is referred to as a concrete mould. For items of different cross-sections to be produced, the concrete moulds have to be changed over. The known slipform pavers therefore have a mounting unit to which concrete moulds of different types can be fastened.

DE A 196 44 397 (corresponds to U.S. Pat. No. 5,662,431) describes a slipform paver having an exchangeable concrete mould. Provided on the chassis of the slipform paver is a mounting unit which can be adjusted in the heightwise direction and which can be displaced at right angles to the direction of operation and to which an appropriate mounting unit which is provided on the concrete mould can be fastened. The mounting unit of the slipform paver has gripping claws which are arranged in pairs and which can be rotated in opposite directions, whereas the mounting unit of the concrete mould has grippable bars which are arranged parallel to one another. To receive the concrete mould, the mounting unit of the slipform paver is positioned above the mounting unit of the concrete mould. Following this, the mounting unit of the slipform paver is lowered. The gripping claws are then pivoted by means of piston-and-cylinder arrangements and thus fit round the grippable bars.

On the one hand it has proved to be a disadvantage that the pivotable gripping claws not only have to carry the entire weight of the concrete mould but also have to withstand all the forces of reaction arising from use. The piston-and-cylinder arrangements therefore have to be under pressure at all times. If they were not, the gripping claws might pivot from the locking position to the open position under the loads involved. On the other hand it is a disadvantage that the mounting unit of the slipform paver has to be precisely positioned above the mounting unit of the concrete mould if the gripping claws are to be able to fit round the grippable bars. It is also a disadvantage in this case that, once the concrete mould has been exactly lined up, the final engaging movement before the locking takes place downwards from above. If the operator makes a mistake, a large proportion of the weight of the machine may therefore rest on the concrete mould or on the changing arrangement, which may result in damage thereto.

In practice it has been found that, while the slipform paver is operating, the changing arrangement not only has to withstand the force generated by the weight of the concrete mould but is also subject to loads in the opposite direction. This is for example the case when the concrete mould is lowered during the advance of the slipform paver to vary the height of the item which is being produced. The changing arrangement then has to withstand the forces which act on the mould from the concrete. However, the changing arrangement having the pivotable gripping claws is not of the optimum design for this because all the forces, regardless of their origin and direction, have to be withstood solely by the gripping claws and the connecting joints that they have.

Known from EP A 2 048 284 is a slipform paver having a changing arrangement, in which two bars arranged one above the other on the concrete mould are hooked into two claw-like fastening members arranged one above the other which are solidly connected to the chassis of the slipform paver. A pivotable gripping claw which fits over one of the two grippable bars in the locking position is used to lock the grippable bars in the fastening members. In the case of this changing arrangement too it is found to be a disadvantage that the very high forces acting in the opposite direction to gravity have to be withstood by the pivotable gripping claw. As well as this, the changing of the concrete mould also once again calls for the fastening members and grippable bars to be exactly aligned. A factor which makes things more difficult in this case is that the fastening members on the mounting unit of the slipform paver have to be brought into engagement with the grippable bars on the mounting unit of the concrete mould from below. A prerequisite for this is that, before the locking, there is an approach movement, below the grippable bars, laterally towards the concrete mould, which may result in the concrete mould, which is always higher and longer than it is wide, being caused to fall over.

The object underlying the invention is to provide a slipform paver to which an arrangement for moulding a flowable material can be fastened easily, safely and securely. As well as this, it is also an object of the invention to provide an arrangement for moulding flowable material for a slipform paver which can be fastened to the slipform paver easily, safely and securely.

The slipform paver according to the invention is characterised in that the mounting unit for fastening on the arrangement for moulding flowable material comprises at least two claw-like fastening members which are arranged, immovably, on the mounting unit in such a way that they are open in the same direction. Associated with the at least two immovable claw-like fastening members of the mounting unit of the slipform paver are at least two substantially cylindrical mating members which are arranged on the mounting unit of the arrangement for moulding flowable material. The at least two claw-like fastening members and the substantially cylindrical mating members may be arranged in a common horizontal plane. It is however also possible for the fastening members and mating members which are respectively claw-like and cylindrical to be arranged to be offset from one another in the heightwise direction. The front fastening members may for example be arranged at a higher level than the rear fastening members without interfering with the approach of the mounting unit of the slipform paver to the mounting unit of the arrangement for moulding flowable material from the rear.

The claw-like fastening members of the slipform paver which are open in the same direction receive the mating members on the arrangement for moulding the flowable material. The horizontal arrangement of the fastening members and mating members makes it possible for the arrangement for moulding the flowable material to be received when the mounting unit of the slipform paver is brought towards the mounting unit of the arrangement for moulding from the rear. There is therefore no need for the mounting unit of the slipform paver to be positioned exactly above the mounting unit of the arrangement for moulding. Also, the concrete mould, which is always higher and longer than it is wide, cannot be knocked over when the mounting unit of the slipform paver is brought up to the mounting unit of the arrangement for moulding from the rear. If the operator makes a mistake, the concrete mould is merely pushed forward without however being able to fall over.

As well as this, it is also of advantage that the immovable fastening members on the slipform paver are able to withstand not only the weight-generated force from the arrangement for moulding and also a force acting in the opposite direction thereto, but also other forces of reaction arising from use, without it being necessary for pressure to be applied to hydraulic or pneumatic cylinder arrangements. The arrangement for moulding is thus suspended securely from the chassis of the slipform paver. Consequently there is not, basically, any need for any further locking. If however locking should be provided, the locking takes place independently of the transmission of force. This differentiation in the design is advantageous inasmuch as the components required for the transmission of force and for the locking can be designed separately from one another to suit the forces which act in the respective cases. What is crucial in this case is that high forces can occur only in the case of the transmission of force but a locking system is not involved in the transmission of force. A possible locking system on the other hand needs to withstand only low forces if indeed it needs to withstand any forces at all.

An alternative embodiment makes provision for the arrangement of substantially cylindrical mating members on the mounting unit of the slipform paver and of claw-like fastening members on the mounting unit of the arrangement for moulding flowable material. Hence, when in what follows the claw-like members of the mounting unit of the slipform paver and the substantially cylindrical members of the mounting unit of the arrangement for moulding flowable material are associated, this should always be understood also to cover the reverse arrangement where the claw-like members are provided on the arrangement for moulding flowable material and the substantially cylindrical members are provided on the slipform paver.

When there is mention of substantially cylindrical mating members, what is meant by this is not only mating members which are circular in cross-section. Instead, the cross-section of the mating members may also be of a shape other than circular. All that is crucial is for the mating members to be able to be received and held by the claw-like fastening members. It is self-evident to the person skilled in the art that any other cross-sectional shape is possible provided that the claw-like fastening members are able to grasp the mating members.

In a preferred embodiment, the claw-like fastening members are so arranged on the mounting unit of the slipform paver that they are open in the direction of operation of the slipform paver. Because, as the slipform paver advances, the arrangement for moulding applies a force which acts in the opposite direction to the direction of advance, the mating members are held against the claw-like fastening members of the slipform paver. Basically, it is however also possible for the claw-like fastening members to be so arranged that they are open in the opposite direction to the direction of operation. However, if this is the case it is essential for the mating members to be locked in the fastening members.

The claw-like fastening members preferably have a receiving region substantially in the form of a hollow cylinder to receive the substantially cylindrical mating members of the mounting unit of the arrangement for moulding flowable material, the claw-like fastening members being arranged on the mounting unit in such a way that the axis which passes through the receiving region substantially in the form of a hollow cylinder extends at right angles to the direction of operation of the slipform paver.

The claw-like fastening members or the substantially cylindrical mating members are preferably arranged on the underside of the mounting unit of the slipform paver. This makes it possible for the arrangement for moulding to be suspended from the underside of the mounting unit.

An embodiment which is a particular preference makes provision for two claw-like fastening members which are at the front in the direction of operation and two claw-like fastening members which are at the rear in the direction of operation to be provided, with the first fastening member at the front and the first fastening member at the rear being arranged one behind the other on a longitudinal axis in the direction of operation and with the second fastening member at the front and the second fastening member at the rear likewise being arranged on a longitudinal axis in the direction of operation. With the fastening members so arranged, longitudinal and transverse forces can be safely and securely withstood. It is also possible for the mounting unit of the arrangement for moulding to be received easily by the mounting unit of the slipform paver. It is however also possible for the front and rear mating members to be arranged to be offset from one another.

An alternative embodiment provides not two claw-like fastening members which are at the front in the direction of operation and two claw-like fastening members which are at the rear in the direction of operation but one claw-like fastening member which is at the rear in the direction of operation and two claw-like fastening members which are at the front in the direction of operation, the fastening member at the rear being centrally arranged and the two fastening members at the front being arranged on the two sides of the fastening member at the rear. It is however also possible for the fastening member at the front to be centrally arranged and the fastening members at the rear to be arranged at the sides.

The claw-like fastening members which are open in the same direction may be configured after the fashion of a hook in such a way that the mating members are secured against slipping out in a horizontal direction. The claw-like fastening members preferably have trough-like depressions to receive the mating members. Basically, trough-like depressions of this kind may be provided in all or only individual ones of the claw-like fastening members.

In a preferred embodiment, trough-like depressions are provided only either in one claw-like fastening member at the front or in one claw-like fastening member at the rear. A sort of fixed mounting can be created in this way with the fastening member at the front or rear and a sort of loose mounting with the fastening member at the rear or front. This has the advantage that production tolerances can be compensated for. A further preferred embodiment provides a locking arrangement for locking the mating members of the arrangement for moulding in the fastening members of the slipform paver. This locking arrangement is not however subject either to the gravity-generated force from the arrangement for moulding or to a force acting in the opposite direction thereto or to any other forces of reaction which occur in different directions in use. Because the claw-like fastening members are preferably open in the direction of operation, the locking arrangement only has to stop the mating members from slipping out of the fastening members if the arrangement for moulding is tilted up. However, this can only happen if the machine is tilted forward at a very steep angle so that the mating members might slip out of the trough-like depressions in the claw-like fastening members. As the slipform paver advances on the other hand, the mating members are pressed into the claw-like fastening members and there is thus no load on the locking arrangement.

The locking arrangement, which in essence has to withstand only forces in a horizontal direction, may take different forms. In a preferred embodiment the locking arrangement has at least one locking member which can be moved between a first position, in which the claw-like fastening members can be slid onto the mating members and a second position in which the mating members are secured in the claw-like fastening members. The at least one locking member of the slipform paver co-operates with at least one abutment member which is provided on the arrangement for moulding. The abutment member of the arrangement for moulding has a face for contact which preferably faces in the direction in which the fastening members of the slipform paver are open. The face for contact of the abutment member may lie in a vertical plane or may be set at an oblique angle to the horizontal plane. An oblique position for the face for contact has the advantage that the locking member of the locking arrangement can be moved in a direction which extends obliquely to the horizontal to enable it to be moved towards and away from the face for contact. It is possible in this way for the means for moving the locking member to be so arranged that they restrict the freedom of movement of the mounting unit of the slipform paver to the least possible extent.

The locking arrangement preferably has at least one piston-and-cylinder arrangement, to the piston of which the locking member is fastened.

In a preferred embodiment, the locking member of the slipform paver has a frusto-conical portion while the face for contact of the abutment member of the arrangement for moulding has a conical recess in which the locking member of the slipform paver is able to locate when the arrangement for moulding is received.

The substantially cylindrical mating members on the mounting unit of the arrangement for moulding are so arranged that they are able to engage in the associated fastening members of the mounting unit of the slipform paver. The claw-like fastening members are able to fit round the substantially cylindrical mating members. The latter are so arranged that their axes extend substantially parallel to one another and at right angles to the direction of operation of the concrete mould. The substantially cylindrical mating members are thus aligned at right angles to the direction in which the highest forces act. The connection between the claw-like fastening members and the mating members is a connection which operates purely by positive interengagement. There is no need for a connection by applied force.

An alternative embodiment once again makes provision for claw-like fastening members rather than substantially cylindrical mating members to be arranged on the mounting unit of the arrangement for moulding flowable material, what are provided on the mounting unit of the slipform paver being not claw-like fastening members but substantially cylindrical mating members.

In a preferred embodiment, two front and two rear or one rear and two front mating members are provided. The mating members may take different forms provided they can be grasped by the claw-like fastening members. The mating members are preferably pins which can be arranged on the mounting unit in such a way as to save space. The mating members may however also be grippable bars.

To enable the arrangement for moulding to be received in a particularly easy way, an embodiment which is a particular preference provides a guiding arrangement having at least one guideway which extends towards a mating member. The at least one guideway preferably extends in the direction of operation of the slipform paver.

An embodiment which is a particular preference provides guideways for all the mating members. The guideways are preferably defined by guiding plates which may be arranged on one or both sides of the guideways. The guiding plates of the guiding arrangement may also be used to fasten the mating members in place.

In the alternative embodiment which has claw-like fastening members on the mounting unit of the arrangement for moulding flowable material, the guideways are provided on the mounting unit of the slipform paver, on which the substantially cylindrical mating members are arranged.

BRIEF DESCRIPTION OF THE DRAWINGS

In what follows, various embodiment of the invention will be explained in detail by reference to the drawings.

DETAILED DESCRIPTION

Figure 1A:
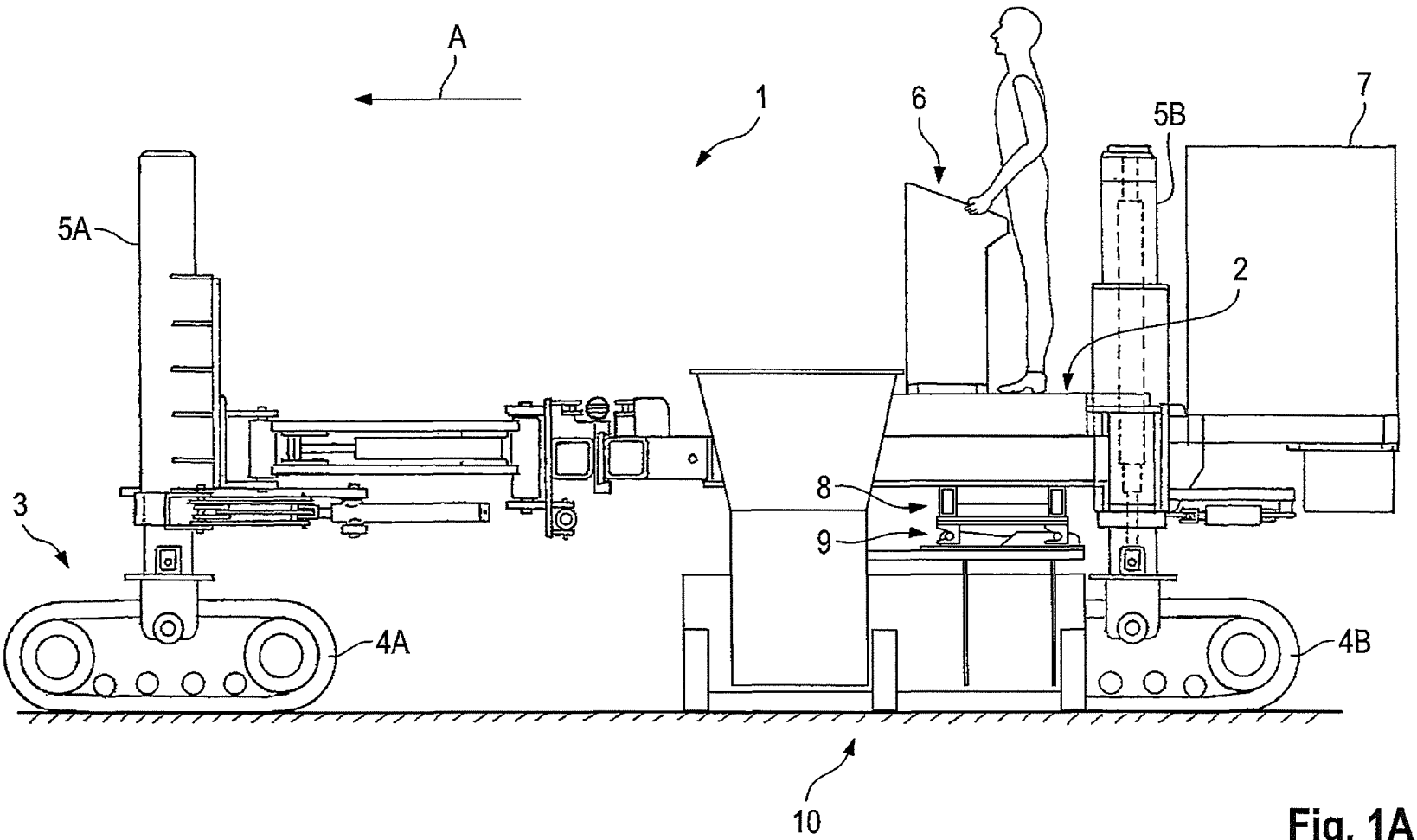
FIG. 1A is a view from the side of an embodiment of slipform paver, not showing a feeding arrangement.
Figure 1B:
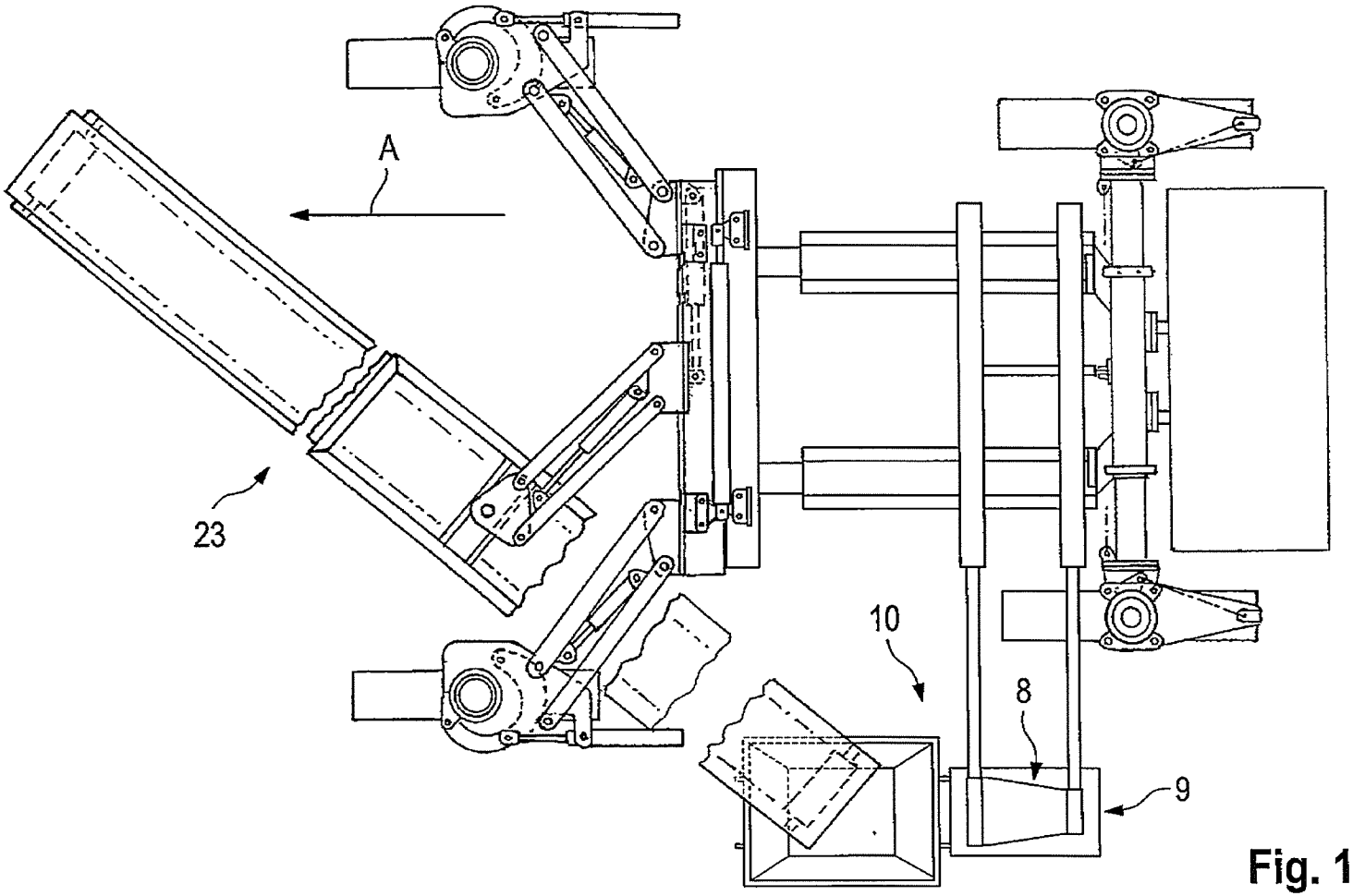
FIG. 1B is a plan view of the slipform paver shown in FIG. 1A, with the feeding arrangement now provided.

FIGS. 1A and 1B show a slipform paver which is described in detail in European patent application EP 1 103 659 A2 (corresponds to U.S. Pat. No. 6,481,924). Because the slipform paver as such is part of the prior art only those components of the civil engineering machine which are material to the invention will be described here.

The slipform paver 1 has a chassis 2 which is carried by running gear 3. The running gear 3 has two front and two rear ground engaging supports such as track-laying units 4A, 4B which are fastened to front and rear lifting columns 5A, 5B, which means that the chassis 2 is adjustable relative to the ground in the heightwise direction. The direction of operation of the slipform paver and the arrangement for moulding flowable material is indicated by an arrow A.

The driver's station 6 of the slipform paver is arranged ahead of the rear lifting column 5B in the direction of travel and operation A and the drive unit 7 for the hydraulic assemblies is arranged to the rear of the rear lifting column 5B in the direction of operation A. Situated below the driver's station 6, on the chassis 2 of the machine, is a mounting unit 8 which can be adjusted in the heightwise direction and at right angles to the direction of operation A and to which there is fastened a corresponding mounting unit 9 belonging to an exchangeable arrangement 10 for moulding flowable material, and in particular concrete, which will be referred to below as a concrete mould. The mounting units 8, 9 of the slipform paver 1 and the concrete mould 10, which are merely indicated in FIGS. 1A and 1B, will now be described in detail by reference to FIGS. 2 to 7.

Figure 2:
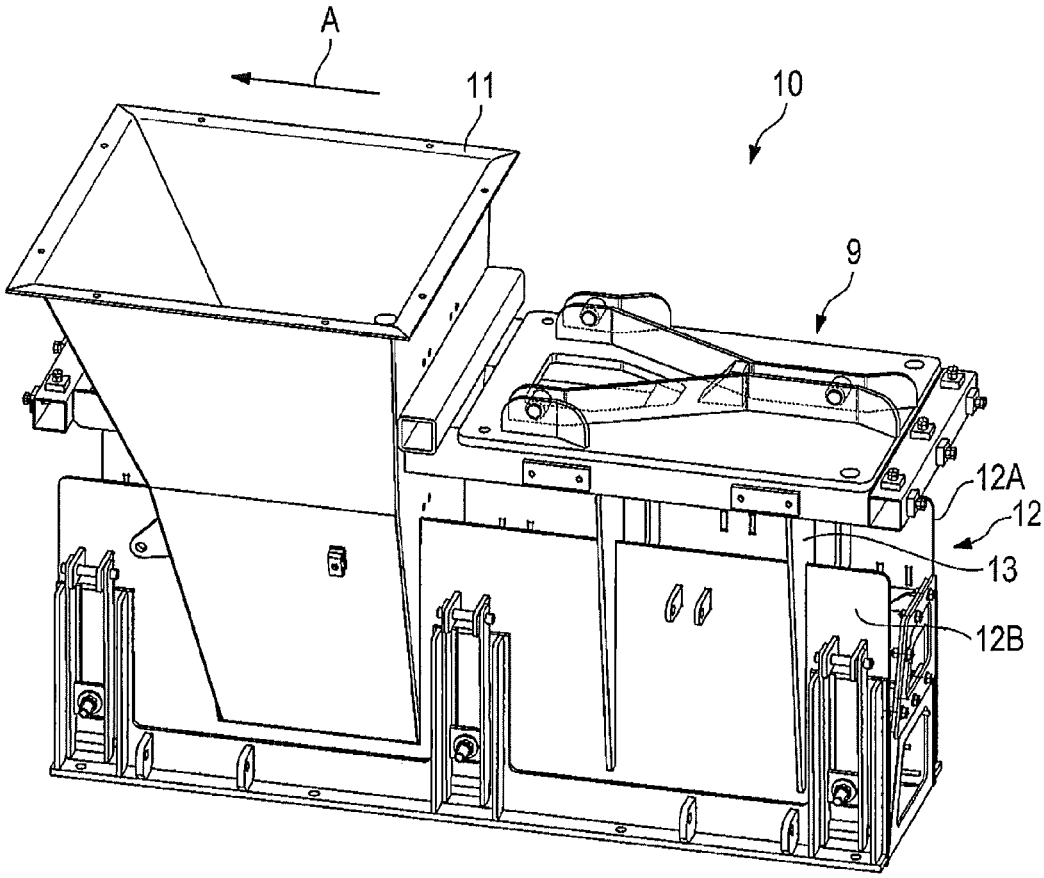
FIG. 2 shows the arrangement for moulding flowable material for the slipform paver shown in FIGS. 1A and 1B.

FIG. 2 is a perspective view of the concrete mould 10, which has a chute 11 which is arranged above a mould proper 12 which is defined by lateral plates 12A, 12B. The chute 11 is used for the infeed of concrete from the feeding arrangement 23 of the slipform paver 1, which is shown in FIG. 1B. Situated to the rear of the chute 11 in the direction of operation A, above the mould 12, is the mounting unit 9 of the concrete mould 10, which is solidly connected to the chute 11 and the mould 12 by struts 13.

Figure 3:
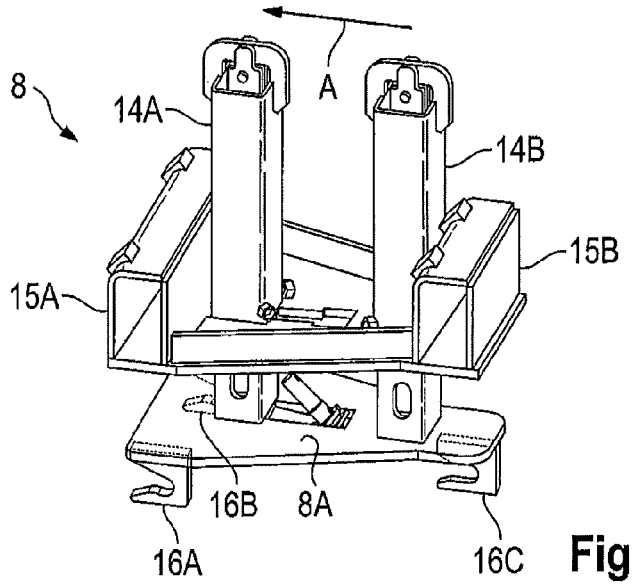
FIG. 3 shows the mounting unit of the slipform paver shown in FIGS. 1A and 1B.

FIG. 3 shows the mounting unit 8 of the slipform paver 1, onto which the associated mounting unit 9 of the concrete mould is mounted. At square-cornered profiles 15A, 15B, the mounting unit 8 of the slipform paver can be moved at right angles to the direction of operation A by piston-and-cylinder arrangements (not shown). The mounting unit 8 has a mounting plate 8A which is fastened in place in such a way as to be adjustable in the heightwise direction relative to the chassis 2 by vertical piston-and-cylinder arrangements 14A, 14B. Fastened to the underside of the mounting plate 8A in a common horizontal plane are two claw-like fastening members 16A, 16B which are at the front in the direction of operation A and one claw-like fastening member 16C which is to the rear in the direction of operation, the mouths 39 of which fastening members face in the direction of operation A. The fastening member 16C at the rear lies on an axis which extends centrally between the fastening members 16A, 16B at the front. However, adjustment of the mounting plate at right angles to the direction of operation and in the heightwise direction is not essential because the chassis of the machine itself can be moved.

The claw-like fastening members 16A, 16B, 16C each have an upper portion and a lower portion 40A, 40B and a rear portion 40C, which portions define a receiving region 41, substantially in the form of a hollow cylinder, to receive mating members belonging to the mounting unit of the arrangement for moulding flowable material which take the form of substantially cylindrical bodies. The claw-like fastening members are so arranged on the mounting unit 8 in this case that the axis 42 which passes through the receiving region 41 of hollow cylindrical form extends at right angles to the direction of operation A of the slipform paver.

Associated with the fastening members 16A, 16B, 16C of the mounting unit 8 of the slipform paver 1 are mating members 17A, 17B, 17C which are provided on the mounting unit 9 of the concrete mould 10 in the same geometrical arrangement. The mating members 17A, 17B, 17C are cylindrical bodies, and in particular pins, which are fastened in place in a common plane on the upper side of a mounting plate 9A of the mounting unit 9. The longitudinal axis 43 of the mating members 17A, 17B, 17C in the form of cylindrical bodies extends at right angles to the direction of operation A of the arrangement for moulding flowable material. That mating member 17C on the mounting plate 9A which is to the rear in the direction of operation is centrally arranged, whereas the two mating members 17A and 17B at the front are arranged on the two sides of the mating member at the rear.

The mating members such as 17A, 17B and 17C may alternatively be referred to as first connecting structures or connecting bars. The fastening members such as 16A, 16B and 16C may alternatively be referred to as second connecting structures or connecting arms.

As well as this, the mounting unit 9 of the concrete mould 10 also has a guiding arrangement 18 for the fastening members 16A, 16B, 16C of the slipform paver 1. The guiding arrangement 1 comprises two lateral front guideways 18A, 18B which taper in the direction of operation towards the front mating members 17A, 17B and one rear guideway 18C which tapers towards the rear mating member 17C. The front guideways 18A, 18B are defined by respective ones of two inner guiding plates 19, 20 and two outer guiding plates 21, 22, the spacing between which decreases in the direction of the mating members 17. Rearwards, the inner guiding plates 19, 20 extend to the mating member 17C at the rear, thus causing them to define the rear guideway 18C from both sides.

For the concrete mould 10 to be mounted on, the mounting unit 8 of the slipform paver 1 is displaced in such a way that the claw-like fastening members 16A, 16B, 16C are situated at approximately the same height as the associated mating members 17A, 17B, 17C of the concrete mould and to the rear thereof in the direction of operation. The mounting unit 8 of the slipform paver 1 is then displaced in the direction of operation and the claw-like fastening members 16 thus fit round the mating members 17. There is no need for any exact positioning because the guiding plates 19, 20, 21, 22 of the guiding arrangement 18 bring the fastening members 16 into line in the appropriate way when the mounting unit 8 is advanced.

The fastening members 16A, 16B at the front each have in their lower limbs a trough-like depression 39A the size of which approximately corresponds to the diameter of a mating member. This creates a sort of hook into which the mating members are securely hooked. Consequently, the fastening members 16A, 16B at the front form a sort of fixed mounting. The fastening member 16C at the rear on the other hand does not have a trough-like depression. The distance between the fastening member 16C at the rear and the fastening members 16A at the front which are situated next to one another is preferably slightly greater than the distance between the mating member 17C at the rear and the mating members 17A, 17B at the front, which means that the mating member 17C at the rear does not butt against the inside of the fastening member 16C at the rear when the mating members 17A, 17B at the front hook into the trough-like depressions 39 in the fastening members at the front. A sort of loose mounting is thus produced with the mating member at the rear and production tolerances are thus compensated for.

The changing arrangement comprising the two mounting units 8, 9 is not only subject to the force generated by the weight of the concrete mould 10 but may also be subject to a force acting in the opposite direction thereto or to other forces of reaction which arise in different directions in use. During the advance of the slipform paver in the direction of operation, the cylindrical mating members 17 are pressed into the claw-like fastening members 16, which are open in the direction of operation. The concrete mould is thus unable to become detached during the normal operation of the slipform paver even when no provision is made for any further locking of the mating members in the fastening members. However, in the present embodiment there is provided on the mounting unit 8 of the slipform paver 1 a locking arrangement 24 by which the mating members are secured in the mouths of the fastening members. However, the locking arrangement only needs to withstand forces when the slipform paver is inclined forward at extremely steep angles, which is not normally the case. Even then the forces which the locking arrangement has to withstand are only low.

In the present embodiment, the locking arrangement 24 has only one locking member 25, which can be moved between a first position in which the mating members are free in the fastening members and a second position in which the mating members are locked in the fastening members due to the fact that the mounting plate 8A of the mounting unit 8 of the slipform paver 1 cannot be moved relative to the mounting plate 9A of the mounting unit 9 of the concrete mould 10 in the opposite direction to the direction of operation.

The locking member 25 is situated on the free end of a piston 26 of a piston-and-cylinder arrangement 27, which piston-and-cylinder arrangement 27 is fastened to the mounting unit 8 of the slipform paver in such a way that the axis of the piston rod 26 extends obliquely to the horizontal. As well as the locking member 25, the locking arrangement 24 also has an abutment member 28 which is provided on the mounting unit 9 of the concrete mould 10. The abutment member 28 has a face for contact 28A which extends obliquely to the horizontal and against which the locking member 25 butts in the locked position, thus preventing the two mounting plates 8A, 9A from being able to be moved relative to one another and securing the mating members 17 in the fastening members 16.

Figure 4:
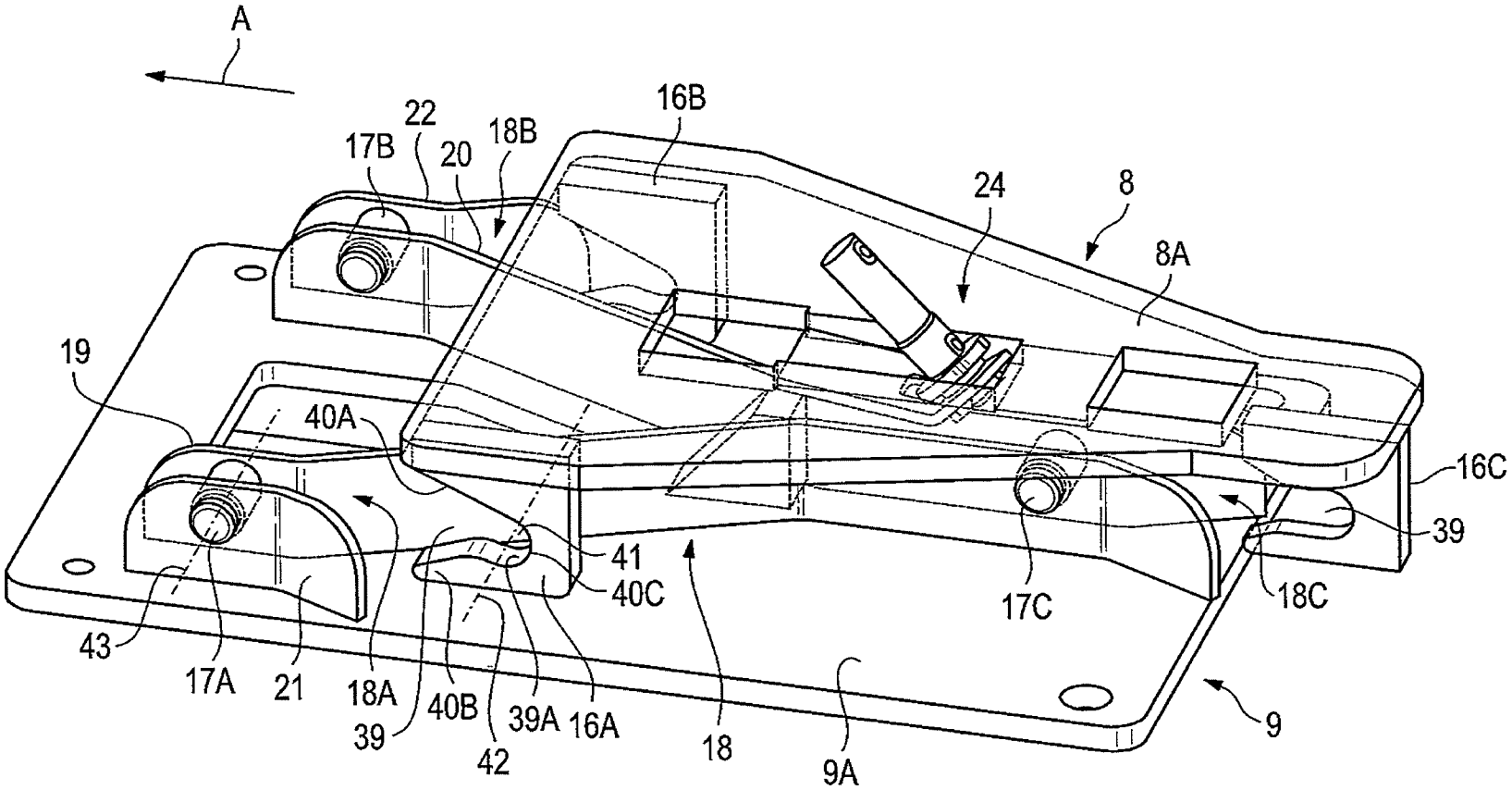
FIG. 4 is a view of parts of the mounting unit of the slipform paver shown in FIGS. 1A and 1B and of the mounting unit of the arrangement for moulding shown in FIG. 2, before the arrangement for moulding is mounted on the slipform paver.

FIG. 4 shows the locking arrangement 24 when the piston 26 carrying the locking member 25 is withdrawn. The mounting plate 8A of the slipform paver 1 can then be slid onto the mounting plate 9A of the concrete mould 10 from the rear.

Figure 5:
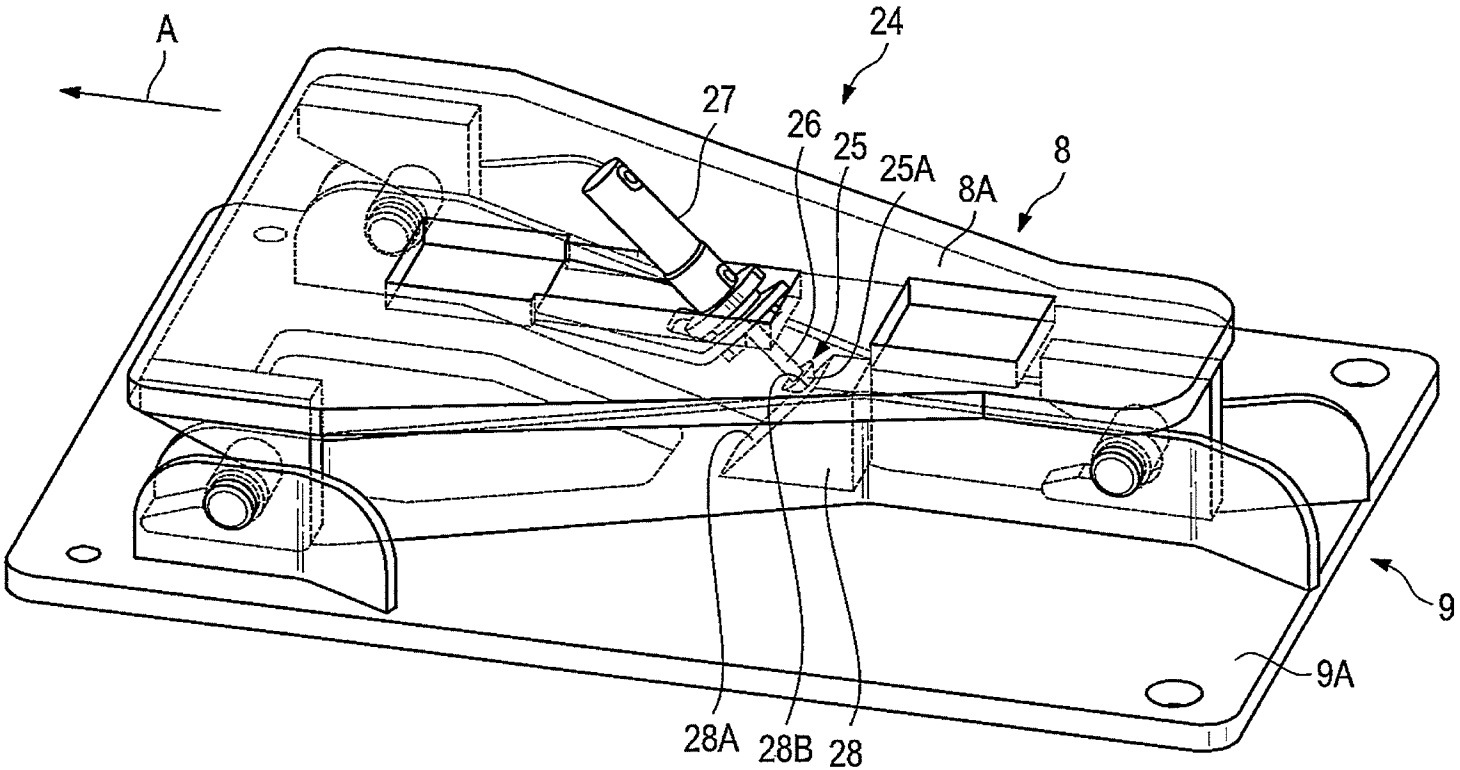
FIG. 5 is a view of parts of the two mounting units shown in FIG. 4, after the arrangement for moulding has been mounted on the slipform paver.

FIG. 5 shows the piston-and-cylinder arrangement 27 when the piston 26 carrying the locking member 25 is extended. The locking member 25 then butts against the face for contact 28A (which face for contact 28A faces in the direction of operation) of the abutment member 28, which latter is arranged at the centre of the mounting plate 9A between the mating members 17. The locking member 25 has a frusto-conical portion 25A which engages in a corresponding conical recess 28B in the face for contact 28A of the abutment member 28. The guiding plates of the guiding arrangement form lateral abutments which are able to withstand quite high forces transverse to the direction of operation, which means that the locking arrangement 24 remains free of loads in this case too.

Figure 6:
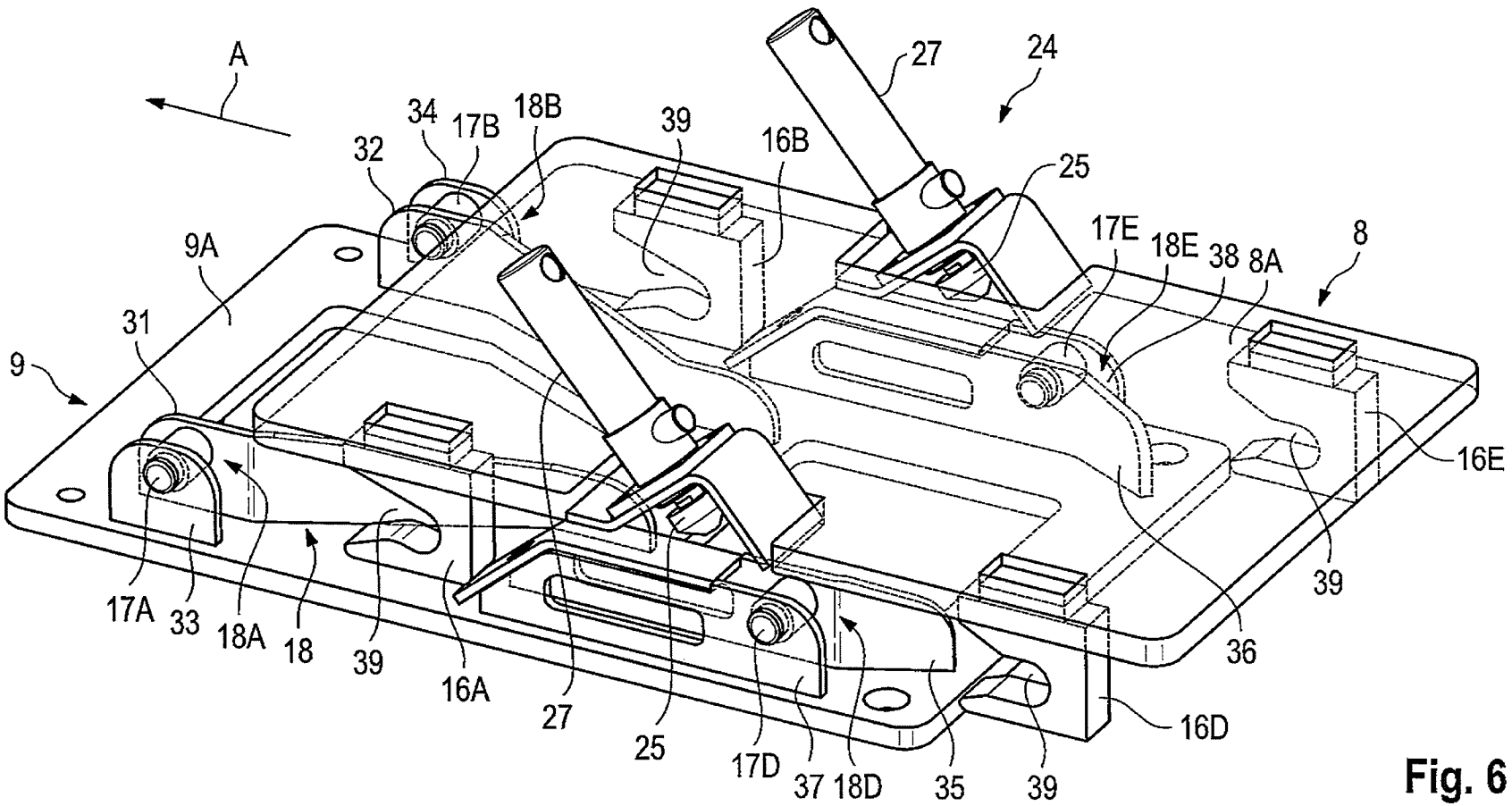
FIG. 6 is a view of parts of a further embodiment of the mounting units of the slipform paver and the arrangement for moulding, before the arrangement for moulding is mounted on the slipform paver.
Figure 7:
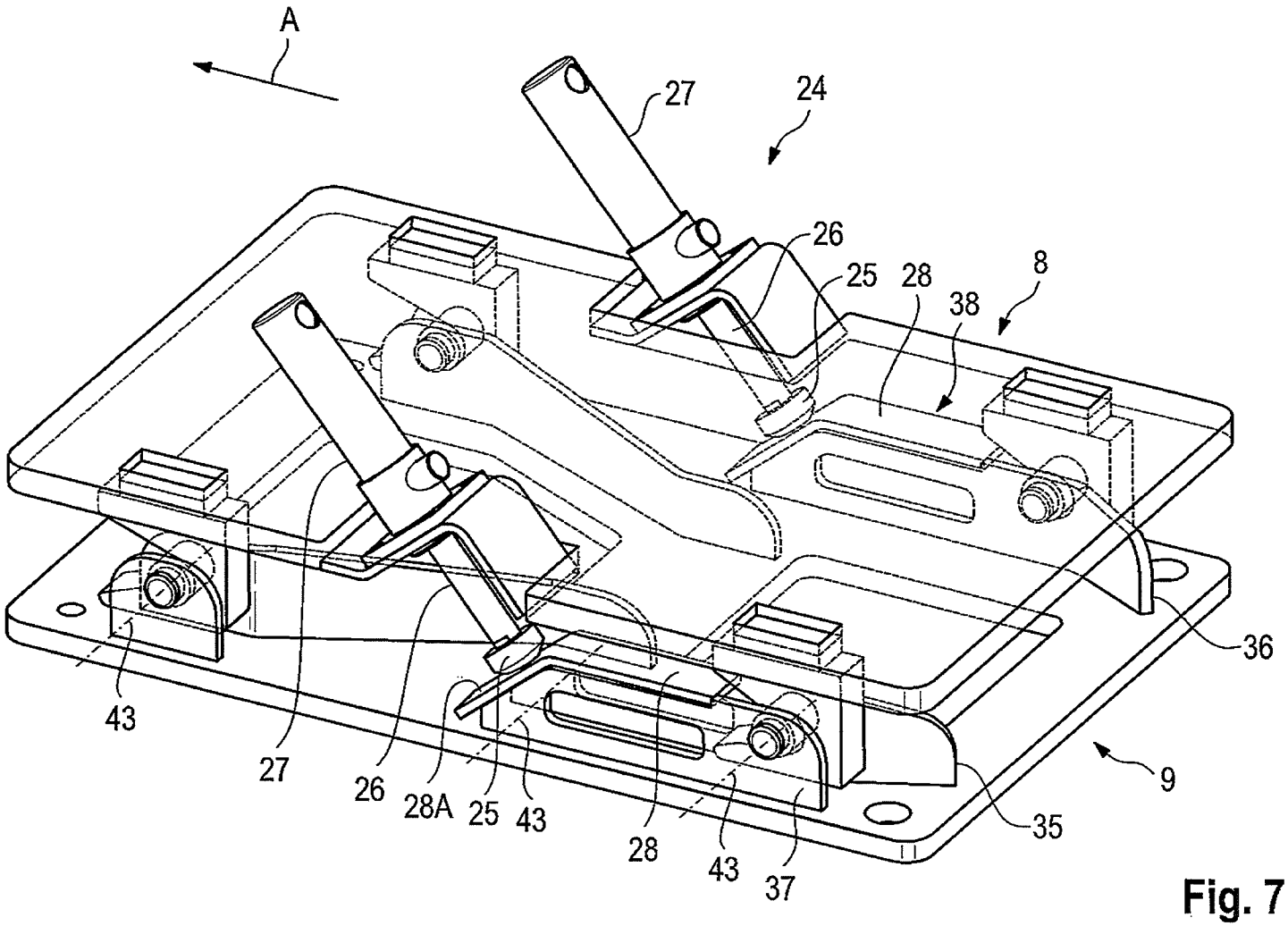
FIG. 7 is a view of parts of the two mounting units shown in FIG. 6, after the arrangement for moulding has been mounted on the slipform paver.

FIGS. 6 and 7 show a further embodiment of the changing arrangement according to the invention for the concrete mould. The embodiment shown in FIGS. 6 and 7 differs from the embodiment which was described by reference to FIGS. 2 to 5 in that, rather than two lateral fastening members and mating members at the front and one centre fastening member and mating member at the rear, what are provided on the mounting plates of the two mounting units of the slipform paver and the concrete mould are, respectively, two fastening members and two mating members at the front and two fastening members and two mating members at the rear. As well as this, the locking arrangement also has not just one but two locking members, which co-operate with two abutment members. Parts which correspond to one another have been given the same reference numerals.

Arranged on the underside of the mounting plate 8A of the mounting unit 8 of the slipform paver 1, in a common plane, are two claw-like fastening members 16A, 16B which are at the front in the direction of operation and two claw-like fastening members 16D, 16E at the rear. The first and second fastening members 16A, 16D and 16B, 16E on the respective sides lie one behind the other on a longitudinal axis. Situated on the upper side of the mounting plate 9A of the mounting unit 9 of the concrete mould 10 in the same geometrical arrangement are four mating members 17A, 17B, 17D, 17E which engage in the mouths 39 of the claw-like fastening members when the concrete mould 10 is received. In this embodiment, the guiding arrangement 18 comprises four guideways 18A, 18B, 18D and 18E which taper towards the mating members in the direction of operation. The front guideways 18A, 18B are defined by respective ones of inner guiding plates 31, 32 and outer guiding plates 33, 34, with the inner guiding plates 31, 32 tapering away from one another in the direction of operation. The mating members 17A, 17B at the front are fastened to the front inner and outer guiding plates 31, 32 and 33, 34 respectively. The mating members 17D, 17E at the rear are fastened to the rear inner and outer guiding plates 35, 36 and 37, 38 respectively, the inner guiding plates extending outwards in the direction of operation.

In the embodiment shown in FIGS. 6 and 7, the locking arrangement 24 has, to lock the mating members in the fastening members, two locking members 25 which are arranged between the fastening members and mating members at the front and rear and which can once again be displaced towards associated abutment members 28 in a direction which extends obliquely to the horizontal. The two locking members are situated at the ends of pistons 26 of the piston-and-cylinder arrangements 27. In this embodiment the abutment members 28 are plates which are fastened to the front, obliquely extending ends of the rear guiding plates 35, 36 and 37, 38 of the guiding arrangement 18. Conical recesses in which the frusto-conical portions of the locking members locate may once again be provided in the faces for contact of the abutment members.

FIG. 6 shows the state to which the mounting unit 8 of the slipform paver 1 is brought to allow it to receive the concrete mould 10, while FIG. 7 shows the state in which the claw-like fastening members 16 fit round the mating members 17. To secure the concrete mould 10 to the slipform paver, the pistons 26 of the two piston-and-cylinder arrangements 27 of the locking arrangement 24 are extended and the locking members 25 thus butt against the faces for contact 28A of the respective abutment members 28. However, in this case the piston-and-cylinder arrangements 27 only have to withstand the forces which act in the direction of operation but not the force generated by the weight of the concrete mould and the forces which act in the opposite direction to the direction of operation. Forces in the direction of operation however do not occur while the slipform paver is operating normally. Should they nevertheless occur in certain situations, these forces are however only low in comparison with the other forces, and the locking arrangement itself is thus subject to only relatively low loads in this case.

FIGS. 1 to 7 show embodiments in which the claw-like fastening members are arranged on the mounting unit of the slipform paver and the mating members, which are in the form of cylindrical bodies, are arranged on the mounting unit of the arrangement for moulding flowable material. It is self-evident to the person skilled in the art that the cylindrical mating members may equally well be arranged on the mounting unit of the slipform paver and the claw-like fastening members on the mounting unit of the arrangement for moulding flowable material, which is equivalent to the layout of the mounting units being reversed kinematically. For this purpose the mounting plate of the mounting unit of the slipform paver carrying the claw-like fastening members merely has to be exchanged for the mounting unit of the arrangement for moulding flowable material carrying the cylindrical mating members. In this case the axes of the cylindrical mating members on the mounting unit of the slipform paver once again extend at right angles to the direction of operation. The claw-like fastening members of the mounting unit of the arrangement for moulding flowable material are open in the opposite direction to the direction of operation. This arrangement corresponds to that of the embodiment which was described by reference to FIGS. 1 to 7 except that the mounting units are rotated through 180° on a horizontal axis, such as the axis 43 for example (FIG. 4). In this alternative embodiment, it is an advantage for the piston-and-cylinder arrangements of the locking arrangement to be provided not on the mounting unit of the arrangement for moulding flowable material but on the mounting unit of the slipform paver, with the associated abutment members being provided not on the mounting unit of the slipform paver but on the mounting unit of the arrangement for moulding flowable material, which means that the hydraulics required to operate the piston-and-cylinder arrangement are not part of the exchangeable concrete mould.

Figure 8:
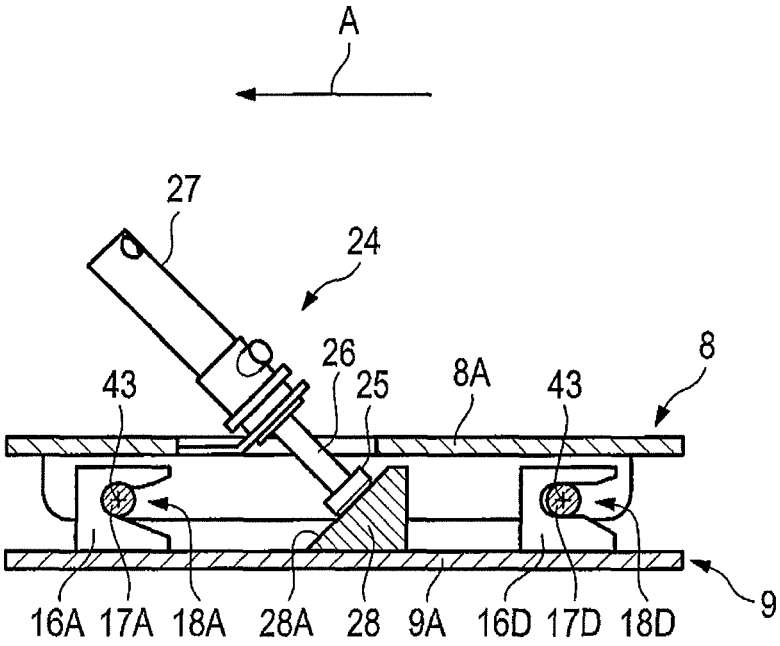
FIG. 8 shows an alternative embodiment in which the substantially cylindrical mating members are arranged on the mounting unit of the slipform paver and the claw-like fastening members are arranged on the mounting unit of the arrangement for moulding flowable material.

FIG. 8 shows the alternative embodiment in which the cylindrical mating members are provided on the mounting unit of the slipform paver and the claw-like fastening members are arranged on the mounting unit of the arrangement for moulding flowable material. Except for the reversed arrangement of the fastening members and mating members, the arrangement shown in FIG. 8 corresponds to the arrangement shown in FIGS. 6 and 7, only the mounting plates of the mounting units which carry the fastening members and the mating members being shown in FIG. 8. Parts of the reversed arrangement which correspond to one another are given the same reference numerals.

In the alternative embodiment, the claw-like fastening members (16A to 16D) are open not in the direction of operation A of the arrangement for moulding flowable material but in the opposite direction to the direction of operation, which means that the cylindrical mating members (17A, 17D) are able to take hold of the claw-like fastening members without the need for locking. While the claw-like fastening members (16A, 16D) are open in the opposite direction to the direction of operation A, the axes 43 of the cylindrical mating members (17A, 17D) extend at right angles to the direction of operation. If no provision is made for locking, the arrangement for moulding flowable material cannot be removed until the slipform paver or rather its mounting unit is displaced in the opposite direction to the direction of operation A.

In the alternative embodiment shown in FIG. 8, the locking arrangement 24 is preferably arranged not on the mounting unit of the arrangement for moulding flowable material and the abutment member 28 is preferably not arranged on the mounting unit of the slipform paver and instead the locking arrangement 24 is situated on the mounting plate 8A of the slipform paver and the abutment member 28 on the mounting plate 9A of the arrangement for moulding flowable material. The locking arrangement 24 is so arranged that its locking member 25 can be displaced in the opposite direction to the direction of operation A, the abutment member 28 being so arranged that its face for contact 28A faces in the direction of operation. It is however possible for the locking arrangement to be arranged on the arrangement for moulding flowable material, which then gives an arrangement which is precisely the reverse of that shown in FIGS. 6 and 7.

The invention claimed is:

1. A self-propelled slipform paver apparatus, comprising:
a chassis having a direction of operation;
a plurality of ground engaging supports;
a plurality of lifting columns extending between the chassis and the ground engaging supports so that a height of the chassis may be adjusted;
a chassis mounting unit connected to the chassis;
a mould for flowable material;
a mould mounting unit connected to the mould;
one of the chassis mounting unit and the mould mounting unit including at least one front claw-like fastening member and at least one rear claw-like fastening member, the claw-like fastening members being open in the same direction either in the direction of operation or opposite to the direction of operation, the claw-like fastening members being immovably attached to their respective mounting unit; and
the other of the chassis mounting unit and the mould mounting unit including at least one front mating member and at least one rear mating member, the mating members being shaped and arranged to be received in the claw-like fastening members.

2. The apparatus of claim 1, wherein:
the chassis mounting unit includes the claw-like fastening members, and the claw-like fastening members are open in the direction of operation.

3. The apparatus of claim 1, wherein:
the mating members are substantially cylindrical; and
the claw-like fastening members each include a receiving region substantially in the form of a hollow cylinder to receive the associated substantially cylindrical mating members, the claw-like fastening members being arranged such that cylindrical axes passing through the hollow cylinder shaped receiving regions extend at right angles to the direction of operation.

4. The apparatus of claim 1, wherein:
the chassis mounting unit has its associated fastening members or mating members arranged on an underside of the chassis mounting unit.

5. The apparatus of claim 1, wherein:
said at least one front claw-like fastening member comprises two front claw-like fastening members; and
said at least one front mating member comprises two front mating members.

6. The apparatus of claim 1, wherein:
at least one of the claw-like fastening members includes a trough-like depression.

7. The apparatus of claim 1, further comprising:
a lock having a first position in which the chassis mounting unit may move relative to the mould mounting unit to engage or disengage the mating members and the fastening members, and a second position in which the mating members are secured in the fastening members.

8. The apparatus of claim 7, wherein:
the lock includes at least one locking member movable from the first position to the second position in a direction opposed to the direction of operation.

9. The apparatus of claim 8, wherein:
the at least one locking member moves obliquely to the direction of operation.

10. The apparatus of claim 8, wherein:
the lock includes at least one abutment member defined on the mould mounting unit, the abutment member being separate from the mating members and the fastening members, the at least one abutment member having a face for contact with the at least one locking member.

11. The apparatus of claim 10, wherein:
the face for contact is a generally flat planar face and faces generally in the direction of operation and is inclined relative to the direction of operation.

12. The apparatus of claim 1, wherein:
the mould mounting unit includes the claw-like fastening members, and the claw-like fastening members are open in a direction opposite to the direction of operation.

13. The apparatus of claim 1, further comprising:
at least one guideway extending toward at least one of the mating members, to guide at least one of the fastening members into engagement with its associated mating member.

14. The apparatus of claim 13, wherein:
the at least one guideway includes at least one guiding plate arranged on one side of the at least one guideway, the guiding plate being arranged at an oblique angle relative to the guideway.

15. The apparatus of claim 1, wherein:
the chassis mounting unit is movable laterally and vertically relative to the chassis at right angles to the direction of travel.

16. A slipform paver apparatus, comprising:
a chassis having a forward direction of operation;
a chassis mounting unit supported from the chassis;
a mould for flowable material;
a mould mounting unit supported from the mould;
one of the chassis mounting unit and the mould mounting unit including forward and rearward connecting bars fixedly attached thereto and extending laterally relative to the direction of operation; and
the other of the chassis mounting unit and the mould mounting unit including forward and rearward connecting arms immovably attached thereto and being open toward the connecting bars, so that when the connecting bars are engaged with the connecting arms, motion of the chassis in the forward direction of operation holds the connecting bars in engagement with the connecting arms.

17. The apparatus of claim 16, wherein:
the connecting bars are attached to the mould mounting unit; and
the connecting arms are attached to the chassis mounting unit and are open in the forward direction of operation.

18. The apparatus of claim 17, wherein:
the mould mounting unit includes two of the forward connecting bars laterally spaced from each other;
the mould mounting unit includes only one rear connecting bar, located laterally between the two forward connecting bars;
the chassis mounting unit includes two of the forward connecting arms aligned with the two forward connecting bars; and
the chassis mounting unit includes only one rear connecting arm aligned with the rear connecting bar.

19. The apparatus of claim 17, wherein:
the mould mounting unit includes two of the forward connecting bars laterally spaced from each other, and two of the rear connecting bars laterally spaced from each other.

20. The apparatus of claim 17, further comprising:
at least one guide channel located on the mould mounting unit rearward of at least one of the connecting bars, for guiding at least one of the connecting arms into engagement with its associated connecting bar when the chassis is driven forward relative to the mould to engage the chassis mounting unit with the mould mounting unit.

21. The apparatus of claim 17, further comprising:
a lock including a piston and cylinder mounted on the chassis mounting unit with the piston extending on a downward and rearwardly inclined angle toward the mould mounting unit, and an abutment fixed on the mould mounting unit and having an inclined forwardly facing abutment surface for engagement by the piston.

22. The apparatus of claim 16, wherein:
at least a first one of the connecting arms includes an upwardly concave recess for closely receiving its associated connecting bar; and
a second one of the connecting arms, spaced from said first one of the connecting arms in the direction of operation, has a continuous engagement surface with no upwardly concave recess, so that an engaged position of the chassis mounting unit relative to the mould mounting unit is defined by engagement of the upwardly concave recess of said first one of the connecting arms with its associated connecting bar.

23. The apparatus of claim 16, wherein:
the connecting bars are attached to the chassis mounting unit;
the connecting arms are attached to the mould mounting unit and are open opposite to the forward direction of operation; and
the apparatus further comprises a lock arranged to selectively lock the mould mounting unit to the chassis mounting unit with the connecting bars engaging the connecting arms.

24. The apparatus of claim 16, wherein:
the chassis mounting unit is movable laterally and vertically relative to the chassis at right angles to the direction of travel.

25. A slipform paver apparatus, comprising;
a chassis having a direction of operation;
a plurality of ground engaging supports;
a plurality of lifting columns extending between the chassis and the ground engaging supports so that a height of the chassis may be adjusted;
a chassis mounting unit connected to the chassis and movable laterally and vertically relative to the chassis at right angles to the direction of travel; and
at least three arms immovably attached to and extending forwardly from an underside of the chassis mounting unit for engaging a mould for flowable material, the at least three arms including at least one forward arm and at least one rear arm, and at least two of the arms being laterally spaced from each other.

26. The apparatus of claim 25, wherein:
the at least three arms include three and only three arms, and the three arms are all laterally spaced from each other.

27. The apparatus of claim 25, wherein:
the at least three arms include two forward arms and two rear arms.

28. The apparatus of claim 25, further comprising:
a locking cylinder and piston mounted on the chassis mounting unit with the piston directed rearwardly and downwardly at an inclined angle.

29. The apparatus of claim 25, wherein:
at least one of the arms includes an upwardly open concave recess for closely receiving a bar of the mould.

30. A mould apparatus, comprising:
a mould for flowable material, the mould having a direction of operation, the mould having a length in the direction of operation and the mould having a width transverse to the direction of operation, the mould having a height, the height and length of the mould being greater than the width of the mould; and
a mould mounting unit connected to the mould, the mould mounting unit including:

at least one forward connecting bar extending transversely to the direction of operation;

at least one rear connecting bar extending transversely to the direction of operation;

at least one guide channel located rearward of at least one of the connecting bars, for guiding a corresponding lifting mechanism of a construction machine into engagement with the at least one of the connecting bars upon forward motion of the construction machine relative to the mould; and at least one forward facing inclined abutment surface defined on the mould mounting unit forward of the at least one rear connecting bar, the abutment surface including a lock receiving recess.

31. The apparatus of claim 30, wherein:

the connecting bars are cylindrical bars.

32. The apparatus of claim 30, wherein:

the at least one forward connecting bar comprises two transversely spaced co-axial forward connecting bars; and the at least one rear connecting bar comprises only one rear connecting bar spaced transversely between the two forward connecting bars.

33. The apparatus of claim 30, wherein:

the at least one forward connecting bar comprises two transversely spaced co-axial forward connecting bars; and the at least one rear connecting bar comprises two transversely spaced co-axial rear connecting bars.

34. The apparatus of claim 33, wherein:

the at least one forward facing inclined abutment surface includes first and second transversely spaced forward facing inclined abutments defined on the mould mounting unit.

35. A method of detachably connecting a mould for flowable material to a chassis of a slipform paver apparatus, the chassis having a forward longitudinal direction of operation and the chassis having a first connecting structure, the mould having a second connecting structure complementary to the first connecting structure and shaped for connecting engagement with the first connecting structure, the method comprising:

(a) with the mould located on a ground surface and not connected to the chassis, locating the chassis relative to the mould so that the first connecting structure of the chassis is located rearwardly of and aligned longitudinally with the second connecting structure of the mould;

(b) driving the chassis forward until the first connecting structure engages the second connecting structure, and thereby connecting the mould to the chassis; and (c) locking the mould to the chassis with a lock separate from the first and second connecting structures, the locking step including extending a piston from the chassis downwardly and rearwardly into engagement with an abutment defined on the mould.

36. The method of claim 35, further comprising:

during step (b), guiding the first connecting member into engagement with the second connecting member with a tapered channel guide.

37. The method of claim 35, wherein:

step (b) further comprises seating the second connecting structure in an upwardly open concave recess of the first connecting structure.

38. The method of claim 35, wherein:

the second connecting structure includes both forward and rearward transversely extending bars, and the first connecting structure includes both forward and rearward forwardly extending arms; and step (b) further comprises moving the forwardly extending arms forwardly under the transversely extending bars until the bars firmly engage the first connecting structure.

39. The method of claim 38, wherein:

step (b) further comprises seating a first one of the bars in an upwardly open concave recess of at least one of the arms while simultaneously supporting a second one of the bars upon its associated arm without seating the second one of the bars in any recess of its associated arm, the first and second ones of the bars being longitudinally spaced.

* * * * *